US009314660B1

(12) United States Patent
Welch

(10) Patent No.: US 9,314,660 B1
(45) Date of Patent: Apr. 19, 2016

(54) EXERCISE BAR

(71) Applicant: Mark Welch, San Antonio, TX (US)

(72) Inventor: Mark Welch, San Antonio, TX (US)

( * ) Notice: Subject to any disclaimer, the term of this patent is extended or adjusted under 35 U.S.C. 154(b) by 0 days.

(21) Appl. No.: 14/541,927

(22) Filed: Nov. 14, 2014

(51) Int. Cl.
*A63B 21/06* (2006.01)
*A63B 21/072* (2006.01)

(52) U.S. Cl.
CPC ..... *A63B 21/0724* (2013.01); *A63B 21/06* (2013.01)

(58) Field of Classification Search
CPC ..... A63B 2021/06; A63B 2021/072; A63B 2021/0722; A63B 21/0004; A63B 21/00058; A63B 21/00061; A63B 21/00065; A63B 21/00069; A63B 21/00079; A63B 21/00109; A63B 21/00116; A63B 21/00134; A63B 21/06; A63B 21/0602; A63B 21/0603; A63B 21/0604; A63B 21/0605; A63B 21/072; A63B 21/0724; A63B 21/0726; A63B 21/0728; A63B 21/075; G10H 2230/265; G10D 13/06
USPC ..... 482/92–93
See application file for complete search history.

(56) References Cited

U.S. PATENT DOCUMENTS 2,509,810 A * 5/1950 Core, Jr. ..... A63B 15/00 16/42 T
3,163,421 A * 12/1964 Matyko ..... A63F 9/0278 463/47.2
3,334,899 A * 8/1967 Bosko ..... A63B 21/0602 446/267
3,482,834 A * 12/1969 James, Jr. ..... A63B 21/0604 482/108
3,637,205 A * 1/1972 Bankston ..... A63B 21/012 473/558
4,480,828 A * 11/1984 Kifferstein ..... A63B 23/04 446/419
4,538,806 A * 9/1985 Wilkerson ..... A63B 21/0726 482/108
4,743,016 A * 5/1988 Van Derworp ..... A63B 21/075 482/93
4,986,535 A * 1/1991 Hull ..... A63B 21/0613 482/112
5,044,250 A * 9/1991 Beyer ..... G10D 13/003 84/422.4
5,244,445 A 9/1993 Amesquita
5,312,314 A * 5/1994 Stephan ..... A63B 21/0602 482/106
5,316,531 A * 5/1994 Spence ..... A63B 15/00 482/106
5,441,471 A * 8/1995 Passer ..... A63B 21/0602 482/106
5,445,587 A * 8/1995 Brown ..... A63B 21/0602 482/108
5,505,114 A * 4/1996 Lawson ..... G10K 3/00 84/404
D372,054 S * 7/1996 Meyer ..... D21/400

(Continued)

*Primary Examiner* — Stephen Crow
*Assistant Examiner* — Andrew S Lo
(74) *Attorney, Agent, or Firm* — Matthew E. Burr

(57) ABSTRACT

The invention discloses a modular, optionally separable, and ergonomically designed weighted exercise bar that provides a low impact method to exercise the muscles of the upper-body, core, and waist. The invention delivers low impact by internally enclosed free shifting loads contained within multiple interior chambers. Taken in combination with an ergonomically designed shape, the muscle strain on the user is significantly reduced. This strain reducing property allows users to increase the intensity and effectiveness of the workout with less likelihood of injury. This reduced strain and likelihood of injury will appeal to users with special needs and other considerations resulting from advanced age or trauma as they will be able to use the exercise bar with greater ease without sacrificing the resulting benefits of the use. The exercise bar also has the benefit of producing rhythmic sounds which can compliment music and enhance the enjoyment derived from its use.

4 Claims, 4 Drawing Sheets

(56) References Cited

U.S. PATENT DOCUMENTS 5,653,664 A 8/1997 Jennings
5,820,531 A 10/1998 Choi
5,876,312 A * 3/1999 McClendon ..... A63B 15/00 482/106
6,120,420 A * 9/2000 Pearson ..... A63B 21/072 482/106
6,379,286 B1 * 4/2002 Scopino ..... A63B 15/00 482/106
6,386,988 B1 * 5/2002 Shearer ..... A63B 21/06 473/220
6,599,222 B2 * 7/2003 Wince ..... A63B 21/0724 482/106
7,749,145 B2 7/2010 Allen
8,038,585 B1 * 10/2011 Brown, Jr. ..... A63B 21/0004 482/108
8,246,525 B2 8/2012 Chen
8,864,634 B2 * 10/2014 Mikulski ..... A63B 21/0603 482/106
9,044,642 B2 * 6/2015 Mikulski ..... A63B 21/0724
2005/0065002 A1 * 3/2005 Su ..... A63B 21/075 482/106
2006/0276270 A1 * 12/2006 Haney ..... A63B 21/0602 473/457
2009/0093348 A1 * 4/2009 Wang ..... A63B 21/0603 482/93
2009/0181788 A1 * 7/2009 O'Connor ..... A63B 21/0004 473/286
2011/0009713 A1 * 1/2011 Feinberg ..... A61B 5/0205 600/301
2012/0309596 A1 * 12/2012 Kennedy ..... A63B 21/0602 482/93

* cited by examiner

EXERCISE BAR

TECHNICAL FIELD

This application relates to an invention in the field of exercise equipment and more specifically to low-impact, weight-shifting, and rhythm-producing weighted bars used in a variety of training, strength-building, or rehabilitative applications.

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

The human body and its physiological functions are based on rhythms. It's a pattern seen in the nervous system, lymphatic system, circulatory system, and respiratory system. Without the correct rhythm, the functionality is impaired causing health issues or even death. The human body instinctively seeks out rhythm.

There are numerous concepts and routines which utilize rhythms and movement to exercise the body. There are gadgets that work the body through gravity, friction, and inertia, including back and forth and in and out motions. For example, there are aerobic dance routines designed to move the body to a musical beat. However, there is a distinct lack of exercise that also creates and adds to the rhythm and beat.

Take the example of a percussionist. With few exceptions, the percussionist in the band is usually in better shape than the other members because of the physical activity involved in generating and moving with the music. A percussionist is compelled to move with the music by the nature of his instruments. The exercise that accompanies the music is merely an incidental benefit. No exercise coach or dance director tells the percussionist how to move or what steps to follow. There is no complicated routine to learn, only the natural drive to follow the beat and rhythm. The exercise is made easy to participate in and more entertaining to perform by the inclusion of the rhythm and beat.

It is well documented that weighted training has health benefits for the body. Weight machines are commonplace in the modern gym and even at home. These machines typically specialize in targeting individual muscle groups in what is known as muscle isolation. Under that philosophy of exercise, isolation is believed to produce visually bigger muscles. While this has an appeal to a certain segment of the population, there is a much broader category of people seeking to improve their physical strength in a way that is less stressful on the body while producing well rounded and coordinated muscle conditioning. Additionally, many exercise machines and equipment are costly, bulky, and limited in use to only specific exercises.

Strength training equipment that has internally shifting weight provides extra force at the end of a movement due to the imparted inertia. Any changing direction of movement can cause internal weights to shift, but the shift is restricted to the directions in which the weights are free to do so. The extra force imparted at the end of a stretching exercise is well known to aid those seeking to improve their range of motion. The benefits of the internally shifting weight result from multiple parts. First, the muscles experience the resistance of accelerating the weighted bar. A second resistance is met with when the acceleration stops or changes direction. This second resistance is from the force imparted by the internal weights against the inner wall of the exercise bar. The muscles experience co-contractions, eccentric contractions (resistance in the same direction as the force), and concentric contractions (resistance opposing the force).

A weighted exercise bar is a good way to exercise the muscles of the arms (biceps and triceps), shoulders (deltoids, supraspinatus, infraspinatus, and teres major and minor), upper back and neck (serratus anterior, rhomboids, and trapezius), chest (pectorals major and minor). Additionally, the core muscles of the abdominals, pelvis and legs are used for balance and stabilization. These muscle groups include the paraspinal muscles of the back, the rectus abdominus, transverse abdominus, and obliques as well as the quads, hamstrings, hip flexors, glutes, anterior tibs, gastroc soleus, and other smaller muscles of the legs. In total, many of the body's muscles are exercised to some degree.

Towards that end, there have been many patents describing weighted exercise bars. While the following prior art patents disclose various forms of an exercise bar, each suffers from multiple problems and limitations which the current invention overcomes. For example, some prior inventions have static weights, providing no weight shifting at all. Other devices are limited in their application and use due to having a fixed weight or length. Other devices suffer from a lack of range of motion in which the device will function as intended. Yet others fail to take body mechanics and ergonomics into consideration. Below is a discussion of the relevant prior art.

Prior art patent U.S. Pat. No. 5,244,445 discloses an "exercise wand" full of shifting "spheres" but describes and claims only a singular hollow tube with fixed end caps. This design has the drawback of requiring a predetermined and fixed length and weight. Users of such a device may not be able to effectively work out with the bar for size or load concerns. The length will further preclude performance of many exercises. Additionally, the prior art teaches towards and claims a limitation of having the inner materials extend between the two ends of the wand so as to occupy 94%-97% of the inner distance of the device. The described spheres are prevented from moving in any direction other than a linear back and forth along the coaxial line extending between the two ends of the wand. This means the benefit of the shifting weight is further limited to exercises that cause the wand to be moved in a coaxial linear motion.

In another prior art, U.S. Pat. No. 5,820,531 discloses an "exercise stick" but claims only a singular hollow tube, the innovation being that the tube has removable hand grips, removable end caps, is at least partially clear, and contains colored sand. The design allows for the device to be used in a few more exercises than the previous prior art described above, however it suffers from a major disadvantage in that the internal load, the sand, tends to pool at the lowest point in the stick. Therefore, once the stick is tilted in any appreciable direction, the sand shifts to the lowest point and is prevented from moving in any direction but up. The movement of the stick in a vertical direction becomes arduous and increases the level of strength required to use the device. Likewise, movement in any direction while the stick is tilted creates an imbalanced strain on the user's arms and back because the sand has shifted the center of gravity towards one side but the majority of the sand is prevented from shifting back and forth due to the stacking of the sand at the low end of the stick. As a result, the total range of motion in which the stick retains its beneficial properties is limited.

Prior art patent U.S. Pat. No. 7,749,145 B2 discloses an "exercise device" in which "[t]he central elongated member 102 can be substantially straight, as shown in FIG. 1, or curved to any known and/or convenient radius." Yet the claims are limited to a singular hollow tube which is either "substantially straight" (claim 1) or "curved" (dependent claim 4). This prior art device suffers from the same limitations as described in the previously discussed prior art. As with the previously discussed patent, the use of a singular interior chamber allows the interior weight to collect in low points of the device. This limits the range of motion over which the device can be used while maintaining the benefits of the weight shifting. As a consequence, the device necessarily limits the total amount of the interior weight to occupying "less than 25% of the volume of the interior." This still fails to overcome the problem of pooling of the internal weight at the lowest point.

Prior art patent U.S. Pat. No. 8,246,525 B2 discloses an exercise weight (shake weight), but this device uses fundamentally different methods and design. The device takes the appearance of a typical barbell shaped free weight. Using guide channels and rollers, the weight can be moved relative to the handle to generate a sliding center of gravity. The restriction of having the load limited to a single axis of movement inherent to the first described patent is also present in this prior art. The device described therein is not comparable to the present invention in terms of mechanics, ergonomics, or type of exercise, let alone range of motion achievable.

Prior art patent U.S. Pat. No. 5,653,664 discloses a "variable weight exercise stick" but teaches away from movement of the internal weight. The design is that two modularly constructed tubes can be connected to one another and loaded with internal weights. Yet the load is composed of static weights held in place with retainers. This prior art reference has other limitations not discussed here, and hence it does not teach all of the aspects of the present invention. The relevant discussion centers on the fact that it teaches away from the critical aspects of the present invention. First, shifting weight is described as unwanted and problematic to the stated objective of the prior art invention, which is to practice the golf swing. The benefits of shifting internal weight have been discussed and will be described in greater detail in the sections that follow. Second, the prior art reference requires a linear configuration to mimic the golf club and function as a training device for golf swings. The ergonomic benefits of a non-linear configuration are also discussed in greater detail in the sections that follow.

BRIEF SUMMARY OF THE INVENTION

The present invention discloses an ergonomically designed modular weighted exercise bar that provides a low impact method to exercise the muscles of the upper-body extending from the fingertips to the shoulders, up to the neck, and down through the core muscles of the chest, lower-back, and waist. The low impact effect is created by internally enclosed and freely shifting weights contained within the exercise bar. Taken in combination with an ergonomically designed shape, the muscle strain on the user is significantly reduced. This strain reducing property allows users to increase the intensity and effectiveness of the workout with less likelihood of injury. Furthermore, users with special needs and considerations resulting from advanced age or trauma will be able to use the exercise bar with greater ease without sacrificing the effectiveness and resulting benefits of the therapy session. The strain reduction is accomplished by optionally arranging the exercise bar into a curved or multi-angled formation, rather than limiting it to a strictly single central axis formation. This allows the bar to be grasped in a more natural position of the forearms. A straight bar requires either a completely pronated (palm of the hands facing down) or supinated (palm of the hands facing up) grip. The forearms are at the extreme end of their anatomic rotation when either pronated or supinated. But by giving the bar angles or a bow shape, the bar can be grasped in a more neutral position, where the person has more strength and flexibility.

Another aspect of the present invention is to provide a more balanced exercise bar. The prior art discussed above demonstrated exercise bars with internally shifting loads which were limited to one elongated internal chamber. The present invention utilizes multiple chambers so that the shifting internal weights can be more evenly distributed across the bar. This has the effect of further reducing possible muscle strain to the user.

Yet another aspect of the present invention is to provide for an exercise bar that can more readily accommodate a wider range of applications and uses by separating into smaller exercise bars. The novel approach of multiple chambers allows the exercise bar to be modularly constructed. The user can optionally remove sections of the exercise bar to tailor the bar to the desired method of use. If for example a particular exercise requires a short bar rather than a long one, or visa-verse, then the user can quickly adapt the bar to their needs.

In still another aspect, the present invention allows users to benefit from the shifting weight by movement in any direction the exercise bar is moved, rather than the limited range of motions seen in the prior art inventions. The use of multiple chambers to contain and distribute the load prevents the internal weights from stacking and interfering with the movement of the internal weights located in other portions of the exercise bar.

In another aspect, the present invention is a simple yet diverse percussive instrument that engages the body's sense of rhythm to motivate the user to use the device for exercise and entertainment.

In another aspect, the invention is the method of using the exercise bar to generate sound that accompanies a rhythm supplied by an instructor in person or by pre-recorded electronic transmission or display.

DETAILED DESCRIPTION OF THE INVENTION

Figure 1:
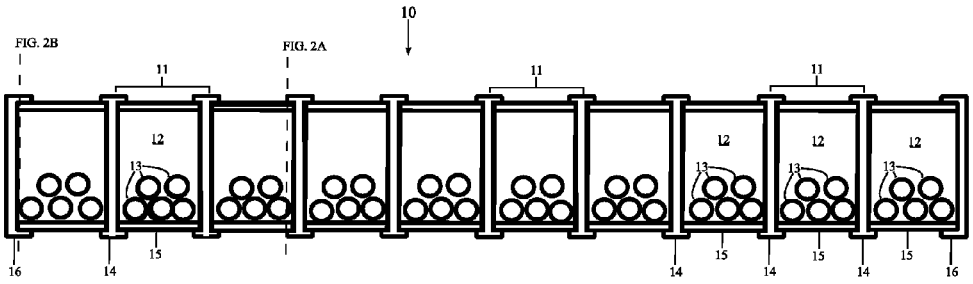
FIG. 1 shows a first embodiment, exercise bar 10.
Figure 2A:
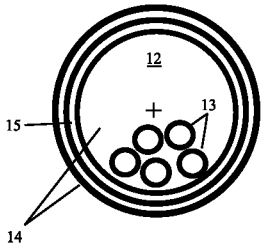
FIG. 2A represents a cross sectional view of modular section 11 at coupling joint 14, of exercise bar 10.
Figure 2B:
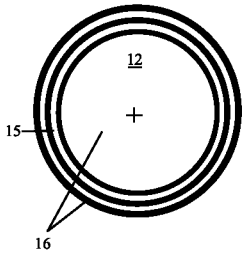
FIGS. 2B and 2D represent a cross sectional view of the end caps 16 and 26 of exercise bar 10 and 20, respectively.
Figure 2C:
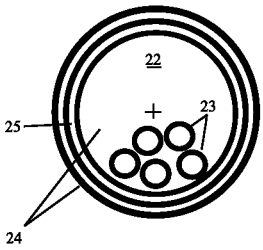
FIG. 2C represents a cross sectional view of straight modular section 21 at coupling joint 24, of exercise bar 20.
Figure 2D:
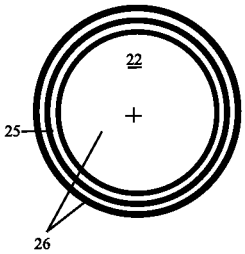

In a first embodiment, the exercise bar 10 is comprised of at least two connected straight modular sections 11. For reference, see FIG. 1. Each modular section 11 is comprised of a straight chamber 12, internal weights 13, and coupling joints 14. In this first embodiment, a straight chamber 12 is formed by a straight cylinder 15 of an external diameter that is suitable for grasping by a human hand. The diameter is preferentially in the range between ½ inch and 6 inches. The straight cylinder 15 is comprised of any suitable material such as aluminum, polyvinylchloride, pvc, steel, or wood. The internal weights 13 are located within the straight chamber 12. The internal weights 13 are comprised of any material suitable for withstanding the impact generated by shaking the exercise bar 10, such as metal bearings, plastic beads, stone pieces, or wooden balls. The coupling joints 14 are located at each distal end of the straight cylinder 15. The coupling joints 14 are of a sufficient diameter to enclose the outer wall of the straight cylinder 15. It is understood that many possible methods of coupling are conceivable and obvious to one of ordinary skill in the art. This includes but is in no way limited to pressure fitted, threaded, and interlocking means, whether internal or external to the straight cylinder 15. The internal weights 13 within the straight chamber 12 are able to move freely within the volume formed by the internal wall of the straight cylinder 15 and the inward facing walls of each coupling joint 14. Each modular section 11 can be connected to another modular section 11 via the coupling joints 14. The user can optionally decide on the number of modular sections 11 to connect. The distal ends of the now connected modular sections 11 are both closed by a cap 16. The cap 16 is a cylinder which is closed on one end and is of sufficient diameter to enclose the outer wall of the straight cylinder 15. For reference see FIG. 2. The means of cap 16 attachment are understood to include many possibilities obvious to those of ordinary skill in the art. For example, the cap 16 could easily be replaced by a plug fitting within the inner wall of the straight cylinder 15.

Figure 3:
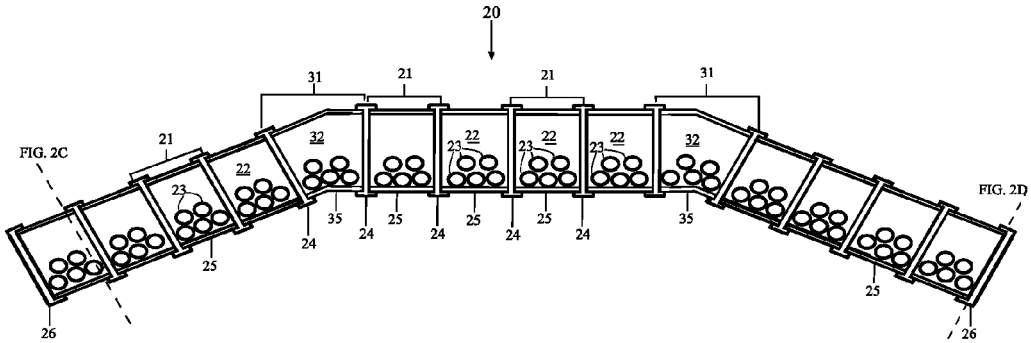
FIG. 3 shows a second embodiment, exercise bar 20.
Figure 4:
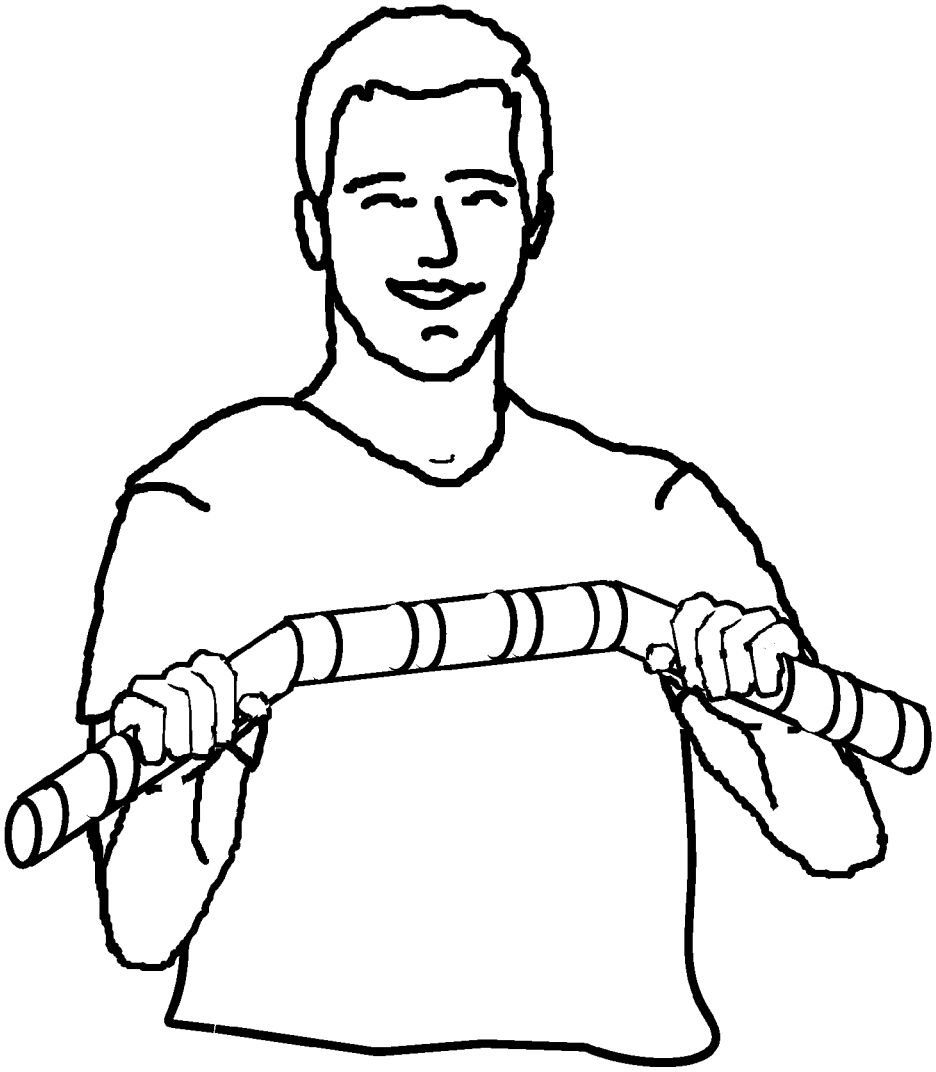
FIG. 4 shows a perspective view of the second exercise bar 20 as held in a typical use.

In a second embodiment, the exercise bar 20 is comprised of several connected modular sections (21, 31) and end caps 26 at the distal ends. For reference, see FIG. 3. In this second embodiment, there are two types of modular sections, straight modular section 21 and angled modular section 31. The straight modular section 21 is comprised by a straight chamber 22 and the angled modular section is comprised by an angled chamber 32. The straight chamber 22 is formed by a straight cylinder 25 of an external diameter that is suitable for grasping by a human hand. The straight cylinder 25 is comprised of any suitable material such as aluminum, polyvinylchloride, pvc, steel, or wood. The internal weights 23 are located within the straight chamber 22. The internal weights 23 are comprised of any material suitable for withstanding the impact generated by shaking the exercise bar 20, such as metal bearings, plastic beads, stone pieces, or wooden balls. The coupling joints 24 are located at each distal end of the straight cylinder 25. The coupling joints 24 are of a sufficient diameter to enclose the outer wall of the straight cylinder 25 and are capable of coupling with both the straight cylinder 25 and the angled cylinder 35. It is understood that many possible methods of coupling are conceivable and obvious to one of ordinary skill in the art. This includes but is in no way limited to pressure fitted, threaded, and interlocking means, whether internal or external to the straight cylinder 25. The internal weights 23 within the straight chamber 22 are able to move freely within the volume formed by the internal wall of the straight cylinder 25 and the inward facing walls of each coupling joint 24. The angled chambers 32 are comprised by an angled cylinder 35 which has coupling joints 24 on each distal end of the angled cylinder 35. As with the straight chambers 22, the internal weights 23 are located within the angled chambers 32 and able to move freely.

Each modular section (21, 31) can be connected to another modular section (21, 31) via the coupling joints 24. The user can optionally decide on the number of modular sections (21, 31) to connect and the placement of the angled modular sections 31. In the preferred second embodiment, exercise bar 20, there are two angled modular sections 31 and they are spaced, relative to one another, at a distance that is equal to or less than the user's shoulder width and equidistant to the center point of exercise bar 20. The distal ends of the now connected modular sections (21, 31) are each closed by a cap 26. The cap 26 is a cylinder which is closed on one end and is of sufficient diameter to enclose the outer wall of the either straight or angled cylinder (25, 35). For reference see FIG. 2. The means of cap 26 attachment are understood to include many possibilities obvious to those of ordinary skill in the art. For example, the cap 26 could easily be replaced by a plug fitting within the inner wall of the straight or angled cylinder (25, 35). The total length of the second embodiment exercise bar 20 is 4 ft. for convenience and ease of use.

In a third embodiment, not shown in drawings, angled coupling joints are used in place of the angled chambers used in the previous embodiment. The two angled coupling joints connect three long segments of straight chambers. The angled coupling joints are comprised of lock collars set at an angle of 45 degrees. In this embodiment the exercise bar is approximately 4 ft. in length, and comprised of sixteen, 3 in. straight chambers, wherein each straight chamber has an outer diameter of 1.5 in. and is filled with approximately ¼ ounce (by volume) of weighted beads. In this embodiment, the total weight of the bar is approximately 5 lbs. Each distal end of the exercise bar is optionally connectable to another smaller segment comprised of a straight chamber with internal weighted beads. Each additional smaller segment is connectable to another segment. These optional chambers can be added or removed by the user to increase or decrease the overall total weight of the bar.

Although the invention has been described and illustrated with a certain degree of detail or with reference to one or more particular embodiments, it is understood that the present disclosure has been made only by way of example. It should be understood that the invention is not intended to be limited to the particular forms disclosed. Furthermore, the invention is amenable to various modifications and alternative forms. Obvious variations and other various changes in the composition, combination, and arrangement of parts can be utilized to by those skilled in the art without departing from the spirit and scope of the invention, as herein disclosed and claimed.

The invention claimed is:

1. An exercise bar comprising:

twelve chambers, wherein said chambers are arranged into three rows forming a first, second, and third segments, and further wherein each of said twelve chambers have a linear central axis;

two chambers, wherein a first of said two chambers has a non-linear central axis defined by an acute angle and is positioned between said first and second segments, and furthermore wherein a second of said two chambers has a non-linear central axis defined by an opposite acute angle of the first of said two chambers and is positioned between said second and third segments; and thirteen coupling joints, wherein one of said thirteen coupling joints is positioned between each adjacent chamber to connect the chambers into one elongate body having a length of four feet; and weights, wherein said weights are located within at least two chambers and are free to move about within said chambers, thereby creating percussive sounds when caused to collide with an internal wall of the at least two chambers.

2. The exercise bar of claim 1 wherein at least two chambers are comprised of elongated tubes of a polygonal or ergonomic cross section with a linear central axis.

3. The exercise bar of claim 1 wherein the bar is comprised of aluminum, polyvinylchloride, steel, or wood.

4. The exercise bar of claim 1 wherein the weights are comprised of polyvinylchloride, steel, stone, or wood.

* * * * *